United States Patent [19]

Holem

[11] Patent Number: 4,657,295

[45] Date of Patent: Apr. 14, 1987

[54] COLLAPSIBLE GROCERY BAG CARRIER

[76] Inventor: Terry W. Holem, 1912 8th St., Winthrop Harbor, Ill. 60096

[21] Appl. No.: 803,737

[22] Filed: Dec. 2, 1985

[51] Int. Cl.[4] ..... A47G 23/06

[52] U.S. Cl. ..... 294/162; 294/169

[58] Field of Search ..... 294/162, 169, 167, 170, 294/159, 148, 161; 206/170, 203, 168, 174, 201; 220/6, 94 R; 229/52 A

[56] References Cited

U.S. PATENT DOCUMENTS

| | | | |
|---|---|---|---|
| 613,973 | 11/1898 | Corlew | 294/169 |
| 2,531,092 | 11/1950 | Waller . | |
| 2,844,279 | 7/1958 | Korvach . | |
| 3,039,651 | 6/1962 | Lang . | |
| 3,254,786 | 6/1966 | Melville . | |
| 3,337,102 | 8/1967 | Shannon . | |
| 4,147,286 | 4/1979 | Bates, III et al. . | |
| 4,235,331 | 11/1980 | Bates, III et al. . | |
| 4,440,430 | 4/1984 | Kruse | 294/55 |

*Primary Examiner*—James B. Marbert

*Attorney, Agent, or Firm*—Cushman, Darby & Cushman

[57] ABSTRACT

An article carrier especially useful for supporting and carrying paper grocery bags includes a rigid, substantially planar upright member and a pair of rigid, substantially planar support members. The support members are hinged to a bottom end of the upright member and are independently movable between raised and lowered positions. When both of the support members are in the lowered position, a contacting edge surface defined by one of the support members contacts a mating contacting edge surface defined by the other support member and a contacting edge surface defined by the bottom of the upright member contacts both of the support members. The mutual contact between the support member contacting surfaces the contact between the support members and the upright member contacting surface retains the support members perpendicular to the upright member under load without need for additional linkages between the upright member and the support members. Hooks fixed to the upper end of the upright member are used to support looped articles such as key rings. Retaining devices fixed to the upper end of the upright member retain the edges of paper grocery bags to lessen movement of the grocery bags with respect to the article carrier during transportation.

6 Claims, 3 Drawing Figures

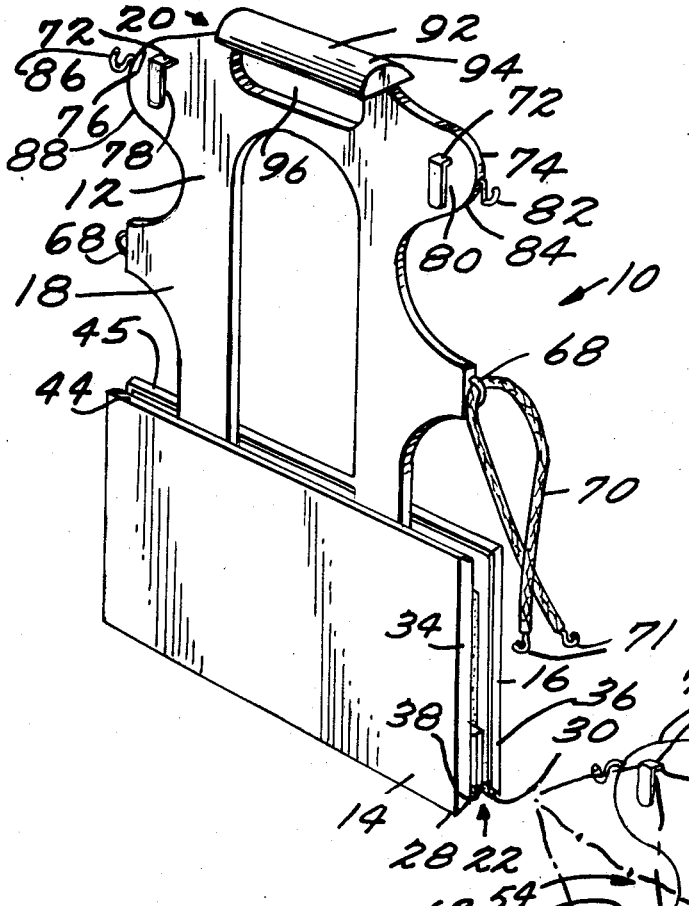
Fig. 1.
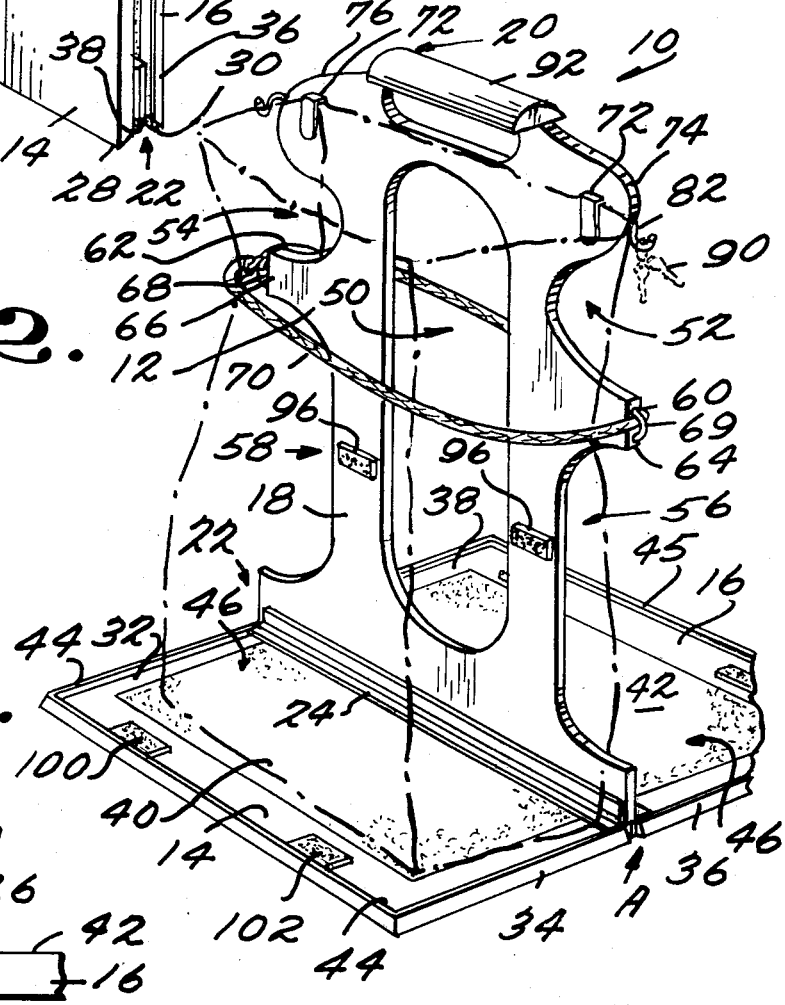
Fig. 2.
Fig. 3.
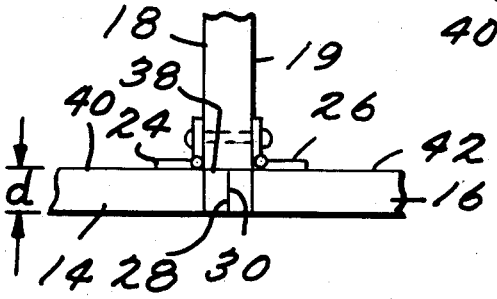

COLLAPSIBLE GROCERY BAG CARRIER

FIELD OF THE INVENTION

The present invention relates to collapsible article carriers, and more particularly, to collapsible carriers designed to support and carry filled paper grocery bags.

BACKGROUND OF THE INVENTION

Nearly everyone has encountered the difficulties of transporting filled grocery bags home from the grocery store. It is most natural to carry an article the size, shape and weight of a filled grocery bag at one's side, grasped by one or two hands, with the arm(s) fully extended downward. It is not, however, possible to grasp a filled paper grocery bag from the top with a single hand or even with two hands because the side of the bag being grasped will tend to rip under the weight of the groceries the bag contains. It is therefore necessary to wrap one's arms around the circumference of the filled grocery bag or support the filled bag from underneath. Filled grocery bags are heavy and bulky, are high enough to obstruct vision when carried in this manner, and are generally extremely difficult to transport. Many of us have experienced the embarassment and inconvenience of dropping a bag full of groceries onto the ground. As we watch oranges and canned goods roll every which way, and liquids previously sealed within glass jars form puddles on the sidewalk, we wish a better way existed to transport grocery bags.

Some of us try to avoid having to carry filled bags of groceries by using shopping carts to move the bags from the grocery store check-out counter to the car. Of course, the groceries must somehow be unloaded from the car upon returning home, and few of us keep shopping carts handy in the driveway. City dwellers who rely on mass transportation or ambulation to get to and from the grocery store are especially disadvantaged, and often may do their grocery shopping only a bit at a time in order to avoid having to carry heavy bags of groceries.

Some grocery stores have recognized the problems associated with standard brown paper grocery bags, and have begun providing their customers with plastic bags instead. Handles are provided at the top of these new plastic grocery bags to make it easier to carry the bags by grasping the top of the bag at the handle. Many people, however, prefer to use paper grocery bags for a variety of different reasons, perhaps the chief one being that they are so versatile for other uses after the groceries have been taken home, removed from the bags and put away in the pantry.

The standard paper grocery bag is a wonderful structure which folds easily into a compact state for storage, and when unfolded, is capable of standing open and erect by itself on its flat bottom without need for support. Due to these unique properties, the standard paper grocery bag is used universally as a receptacle for trash or other articles. Standard paper grocery bags are inexpensive, completely bio-degradable and can hold more than can the new plastic grocery bags designed to replace them. Due to the preferences of customers and grocers alike, the brown paper grocery bag will no doubt continue to be used for many years to come.

Some in the past have devised article carriers designed to support filled grocery bags. Collapsible grocery bag carriers including a center wall serving as a handle and support, dual support platforms pivotally mounted to the center wall and extendable to horizontal positions for supporting grocery bags, and folding U-shaped support brackets for retaining grocery bags in the carrier are, in general, known. The following references disclose collapsible article carriers of this general type:

U.S. Pat. No. 2,844,279 to Kovach
U.S. Pat. No. 4,147,286 to Bates, III et al
U.S. Pat. No. 4,235,331 to Bates, III et al
U.S. Pat. No. 2,531,092 to Waller
U.S. Pat. No. 3,039,651 to Lang
U.S. Pat. No. 3,337,102 to Shannon and
U.S. Pat. No. 3,254,786 to Melville.

The Kovach patent discloses a collapsible article carrier including vertical handle bale wires 10 pivotably attached to which foldable base plates 1 and 1' and foldable cross wires 7 and 7'. U-shaped rectangular frames 4 interconnect cross 25 wires 7 and 7' and base plates 1 and 1'.

Bates, III et al '286 and Bates, III et al 331 both disclose collapsible baskets for carrying side-by-side grocery bags. These references teach using link members or bars pivotably mounted to a vertical center structure to help retain foldable bottom platforms in a horizontal position.

Waller discloses a collapsible bottle carrier including link members 40–43 connecting handle 38 via end members 33–36 to bottom sections 14 and 16 to support the bottom sections when the carrier is unfolded.

Lang teaches a collapsible molded plastic carton including bottom panels 10 and 12 pivotably connected to end panels 7 and 4a.

The Shannon reference discloses a collapsible article carrier capable of carrying a single grocery bag. The Melville patent discloses a folding carrying case having a bottom horizontal platform defining a non-skid surface.

Unfortunately, the article carriers disclosed in these references are all rather complicated. The grocery bag carriers taught by these references all include support means (such as linkages) of one sort or another connecting the upper end of a central vertical member or frame to the extremities of horizontal support members in order to provide sufficient strength to support filled bags of groceries. If the grocery bag carrier is to be truly collapsible and easy to assemble, some means to rotatably journal these linkages to both the upright member and to the horizontal platforms must be provided, adding complexity and expense to the carrier as well as increasing the number of parts and making manufacture more difficult.

SUMMARY OF THE INVENTION

The present invention is a portable, collapsible article carrier which is easy to use, economical to produce and easy to assemble. An upright, substantially planar member defines a handle at an upper end thereof and a planar surface along the edge of a lower end thereof. First and second rigid, substantially planar support members each define a contacting surface on an edge thereof. Hinges attach the first and second support members to opposing surfaces of the upright member lower end and permit the support members to independently move between raised positions substantially parallel to the upright member and lowered positions substantially perpendicular to the upright member.

The support members are each connected to the upright member only by the hinges when the support members are in the lowered position. The contacting surface defined by the first support member contacts the contacting surface defined by the second support member and the upright member planar surface contacts both the first and the second support members whenever both support members are in the lowered position. By virtue of this arrangement, the horizontal support members remain in the horizontal position even when loaded by bags full of groceries.

The article carrier of the present invention is lightweight, economical to produce, and easy to assemble and use. Because the device is uncomplicated and has only a few moving parts, it is inexpensive to manufacture and easy to assemble and disassemble. Moreover, the article carrier of the present invention can be manufactured with readily-available tools using just about any rigid material (e.g. wood). The article carrier can be carried and stored easily when in its collapsed configuration, and yet is easy to unfold for use. Although the article carrier of the present invention is particularly adapted for supporting and carrying filled grocery bags, it can be used to support and carry nearly any article having a suitable size and shape.

BRIEF DESCRIPTION OF THE DRAWINGS

These and other features and advantages of the present invention will be better understood by studying the following detailed description of a presently preferred exemplary embodiment in conjunction with the appended sheet of drawings, of which:

FIG. 1 is an elevated side view in perspective of a presently preferred exemplary embodiment of an article carrier in accordance with the present invention shown in a collapsed position;

FIG. 2 is an elevated side view in perspective of the embodiment shown in FIG. 1 in an unfolded position; and FIG. 3 is an elevated side view in detail of portion A of the embodiment shown in FIG. 2.

DETAILED DESCRIPTION OF A PREFERRED EMBODIMENT

FIGS. 1 and 2 are elevated side views in perspective of a presently preferred exemplary embodiment of an article carrier 10 in accordance with the present invention in a collapsed and an unfolded position, respectively. Article carrier 10 includes an upright member 12 and first and second support members 14 and 16. Support member 14 is attached to a first opposing surface 18 of a bottom end 22 of upright member 12 with an elongated piano hinge 24 traversing substantially the entire width of the upright member and the support member. Similarly, support member 16 is attached to a second opposing surface 19 of upright member 12 at bottom end 22 of the upright member with an elongated piano hinge 26. Piano hinges 24 and 26 permit support members 14 and 16 to independently move between raised positions substantially parallel to upright member 12 (as shown in FIG. 1) and lowered positions substantially perpendicular to the upright member (as shown in FIG. 2).

In the preferred embodiment, support members 14 and 16 are rigid and substantially planar, and are of approximately equal size and shape. Support members 14 and 16 may be rectangular in shape and have dimensions of 12 inches (along the edges 28, 30)×7 and 3/16 inches (along edges 32, 34, 36, 38 perpendicular to edges 28, 30)×d (where d is a suitable thickness). One plate of each of piano hinges 24, 26 are attached to a corresponding support member 14, 16 (by conventional fastening means such as wood screws, nuts and bolts, or the like) about ⅜ inch from edges 28, 30 of the support members in the preferred embodiment, while the other plates of the hinges are attached to upright member 12 at the edge 38 of bottom end 22 thereof.

As can best be seen in FIG. 1, edges 28, 30 of support members 14, 16 overhang lower edge 38 at the bottom end 22 of upright member 12 when support members 14, 16 are in the raised position (the amount of overhang is about ⅜ of an inch in the preferred embodiment, nearly or exactly half the thickness of upright member 12). Edges 28, 30 of support members 14, 16 and edge 38 of upright member 12 form contacting planar surfaces which support the support members 14, 16 in positions perpendicular to the upright member when the support members are both in the lowered position.

As can best be seen in FIG. 3, edge surface 28 of support member 14 contacts edge surface 30 of support member 16 when support members 4 and 16 are both in the lowered position, the edge surfaces 28, 30 contacting one another over substantially the entire surface area of each. Moreover, approximately half of the surface area of edge 38 contacts a support surface 40 of support member 14 when the support member is in the lowered position, while the other half of the surface area of edge 38 contacts a support surface 42 of support member 16 when that support member is in the lowered position.

There is zero clearance between contacting edge surfaces 28 and 30 when support members 14 and 16 are both in the lowered position. Likewise, there is zero clearance between the surface of edge 38 and support surfaces 40, 42 when support members 14 and 16 are both in the lowered position. In the preferred embodiment, contacting edge surfaces 28, 30 and 38 are all planar and are all perpendicular to the adjoining surfaces of the members they terminate. The line of contact between edge 38 and support surfaces 40 and 42 is substantially perpendicular to the line of contact between edges 28 and 30 when support members 14 and 16 are both in the lowered position.

The thickness d of support members 14 and 16 (d is the same for both support members in the preferred embodiment) is chosen to be large enough that the support members are relatively rigid and will not crack or permanently deform under load. Thickness d is also chosen to be large enough to ensure that contacting edge surfaces 28 and 30 are wide enough to support the support members 14, 16 and maintain them in a horizontal position (assuming upright member 12 is in a vertical position) even under substantial loading of the support members. In the preferred embodiment, support members 14 and 16 are made of wood and thickness d is approximately ¾ of an inch. Similarly, upright member 12 is composed of wood having a thickness of ¾ of an inch such that the halves of contacting edge 38 of upright member 12 contacting support surfaces 40, 42 each have a width of ⅜ of an inch.

When a full bag of groceries is placed onto, for example, support surface 40 of support member 14, gravity acting on the bag exerts a force on the support member in a downward direction (i.e., a direction normal to surface 40 if support member 14 is horizontal). The weight of the bag of groceries is distributed substantially evenly across support surface 40. Force applied to support surface 40 in proximity to hinge 24 tends to load hinge 24 without producing much of a moment about the axis of the hinge. However, force acting on support surface 40 near an edge 44 opposite contacting edge 28 produces a rather large moment (due to the distance between hinge 24 and edge 44), which tends to flex (rotate) support member 14 away from a position perpendicular to upright member 12 and toward a position whereat the angle between the upright member and support member 14 is obtuse. A limited degree of flexing of support member 14 is desirable to prevent the support member from cracking or permanently deforming under heavy loads.

Force exerted downward on support surface 40 in proximity to edge 44 causes force to be exerted against contacting surface 30 by contacting surface 28 and against contacting surface 38 by support surface 40. Provided the widths of contacting surfaces 28, 30 and 38 are sufficiently large, support member 14 will crack or bend and/or hinge 24 will become detached from the support member or upright member 12 before relative movement of contacting surfaces 28, 30, 38 and 40 occurs under extremely heavy loading.

Carrier 10 is designed to carry two grocery bags simultaneously, one supported by support surface 40 and the other supported by support surface 42. The weight of a grocery bag supported by support surface 40 is typically approximately balanced by the weight of another grocery bag supported by support surface 42, so that carrier 10 is balanced when supporting two grocery bags. Of course, carrier 10 can be used to support a single bag if desired, although both support members 14, 16 should be moved to the lowered position so that the relationship between the various contacting surfaces exists as shown in FIG. 3 before an article is placed on either support surface 40, 42. Support members 14, 16 are each dense enough that they do not tend to move away from the lowered position during movement of carrier 10 even when unloaded and/or when a surface on which carrier 10 has been rested is not perfectly flat or is in motion (such as when the carrier is rested on a car seat).

As mentioned previously, support members 14, 16 may tend to flex slightly downward from a horizontal position under heavy loading (e.g. when grocery bags filled with canned goods or other heavy articles are disposed on the support members). To prevent the grocery bags from sliding off support surfaces 40, 42 when such flexing occurs, the preferred embodiment includes lips 44 extending upward from edges 32, 34, 36, 38, 44, and 45. If support members 14, 16 are made of wood, lips 44 can comprise standard wooden edging dowels or the like. Lips 44 need project only slightly above the level of support surfaces 40, 42 to prevent grocery bags from sliding off of the support surfaces.

Support surfaces 40, 42 preferably each are non-skid surfaces which define a pattern 46 of projections and indentations. Pattern 46 can be defined by a rubber mat adhered to the support surfaces, or may be defined by grooves cut into the surfaces themselves. Pattern 46 increases the friction between support surfaces 40, 42 and the bottoms of grocery bags supported by the support surfaces to help prevent the grocery bags from sliding even when support surfaces 40, 42 are moved away from a horizontal position (e.g. when carrier 10 is tipped slightly or swung through a portion of an arc).

Upright member 12 in the preferred embodiment is made of a sheet of wood cut according to a desired pattern using a jigsaw or the like. Upright member 12 may be formed from a rectangular piece of wood having dimensions of approximately 19 and $\frac{3}{4}$ inches$\times$12 inches $\times\frac{3}{4}$ inches. A rather large oval-shaped hole ("cut-out") 50 about 4 and $\frac{3}{8}$ inches wide in the preferred embodiment is cut in upright member 12 from top to bottom to help minimize the weight of article carrier 10 and for aesthetic reasons. In the preferred embodiment, at least 1 and $\frac{1}{2}$ inches of material is left between the outer circumference of cut-out 50 and the outer side edges of upright member 12 to provide the upright member with sufficient strength and rigidity.

The exterior side edges of upright member 12 are also cut out at cut-outs 52, 54, 56 and 58. A projection 60 separates cut-outs 52 and 56, while a projection 62 separates cut-outs 54 and 58. The distance between a flat edge 64 terminating projection 60 and a flat edge 66 terminating projection 62 is approximately 12 inches. A loop 68 (formed, for example, by a metal eye) projects from edge 66. An elastic stretch band 70 of conventional design (of the type available in most sporting good and hardware stores) is fixedly attached to flat edge 64 of projection 60 with a wire staple, metal band or the like (reference numeral 69). Conventional stretch band 70 terminates at each end with a hook 71 adapted to attach to loop 68.

A pair of tabs 72 are fixedly attached to projections 74, 76 projecting from the top end 20 of upright member 12. The spacing between tabs 72 is approximately 10 or 11 inches in the preferred embodiment. Tabs 72 are each located the same predetermined distance from the plane of lowered support members 14, 16 equal to or singly greater than the height of a standard paper grocery bag. Tabs 72 each comprise a rigid L-shaped member wherein the end of the short leg of the "L" is fixed to upright member 12 and the long leg of the "L" faces toward support members 14, 16. Two sets of tabs 72 are provided—one set is fixed to surface 18 of the upright member 12, while the other set is fixed to surface 19 of the upright member (the opposite side of the upright member).

The long legs of tabs 72 are parallel to upright member 12 and are spaced a predetermined, relatively small distance therefrom (or alternatively, may be in contact with the upright member so long as the tabs are flexible). Retaining slots 78, 80 are defined by the distance between tabs 72 and upright member 12, these retaining slots being adapted to accept and retain the edge of a conventional paper grocery bag (as can best be seen in FIG. 2). The spacing between tabs 72 is preferably just slightly more than the side dimension of a conventional paper grocery bag. In the preferred embodiment, tabs 72 are approximately $\frac{1}{2}$ inches wide and 1 and $\frac{1}{2}$ inches long, although alternate configurations are possible. Tabs 72 may be made of wood, metal or other materials and may be attached to upright member 12 by any convenient method.

A hook 82 extends from a side edge 84 of projection 74. Similarly, a hook 86 extends from a side edge 88 of projection 76. Hooks 82, 86 in the preferred embodiment are conventional metal hooks oriented so that the opening of the "U" of the hook faces upward when upright member 12 is oriented vertically. Hooks 82, 86 may be used to support key rings 90 or other looped articles or filaments. This feature of the present invention is particularly useful, since it eliminates the need to put article carrier 10 down in order to search through pockets or a purse to find keys to open a car trunk or the door of a house.

A handle 92 in the preferred embodiment is centrally located on the upper end 20 of upright member 12. In the preferred embodiment, handle 18 includes a 5 and ½ inches long hemispherical dowel 94 spanning a U-shaped opening 96 defined in the top end 20 of upright member 12. Dowel 90 is permanently fixed to upright member 12 by any convenient member (such as glue, wood screws, or a combination of the two).

To collapse article carrier 10, one need only move both of support members 14, 16 to their raised positions. The preferred embodiment includes fastening means (velcro strips 96, 98, 100 and 102) which temporarily fasten support members 14, 16 to upright member 12 and thus retain the support members in the raised position. When carrier 10 of the preferred embodiment is in the collapsed configuration (as shown in FIG. 1), it has overall 15 dimensions of only 12"×19¾"×1⅛", and may thus easily be stored away in the trunk of a car or in a closet.

To use carrier 10, support members are unfastened from upright member 12 and moved to the lowered position (if possible, support members 14 and 16 should be moved to their lowered positions simultaneously to ensure contacting edge surfaces 28 and 30 mate properly with one another). A bag of groceries may be placed upon support surface 40, and another bag of groceries may be placed upon support surface 42. Top edges of the grocery bags closest to upright member 12 are bent slightly and slid into retaining slots 78, 80 before the bags are moved into full contact with surfaces 18, 19. Stretch band 70 is then stretched around both grocery bags and hooks 71 are hooked to loop 68. The grocery bags are thus held snugly against upright member 12 and are prevented from sliding by pattern 46. Carrier 10 can be lifted from handle 92 and moved without fear that the grocery bags might fall from the carrier.

An article carrier especially suited for carrying grocery bags has been described. Using article carriers of the present invention, one person can carry many full bags of groceries or other various items easily. The article carrier can sit securely on its own so that the user can have both hands free, and thus prevents full bags of groceries from tipping over while being transported in a car or other vehicle. Hooks 82, 86 are convenient for supporting keys, handbags and the like. The article carrier of the present invention is lightweight and easy to use, so that it can be used for picnicking, at the beach or at the pool, and for carrying camping equipment, sporting equipment, or any other items that would be difficult to pack in a suitcase. The article carrier folds to a small size so that it can be easily stored when not in use. The article carrier is easy to use for everyday convenience, is inexpensive to produce, and has a potentially large market.

Although the invention has been described with reference to a preferred exemplary embodiment, it is to be understood that modifications may be made while retaining many of the novel advantages and features of the invention. For example, although the preferred embodiment is of wooden construction, nearly any sufficiently rigid material (e.g. plastic, metal, or the like) could be used. Stretch band 70 can be replaced with a pair of U-shaped metal rod-like members which are rotatably journalled to upright member 12 and movable between a raised position parallel to the upright member and a lowered position perpendicular to the upright member. Tabs 72 can be replaced by a single strip or flap of material spanning across upright member 12 if desired. Additional support for support members 14, 16 can be provided by adding cords or rods connecting upright member 12 with the support members. Although such additional support is not necessary in the preferred embodiment to carry filled grocery bags or other articles of similar weight, it might be desired if extremely heavy articles are to be carried. Upright member 12 can comprise a rectangular sheet of material with no cut-outs or could be replaced with a wire frame if desired. Although the preferred embodiment includes a pair of support members 14, 16, one of the support members could be eliminated if desired and the contacting edge surface of the remaining support member could be arranged to contact the side surface of upright member 12 when the support member is in the lowered position. The invention is not to be limited to the disclosed embodiment, but on the contrary, it is intended to cover various modifications and equivalent arrangements included within the spirit and scope of the appended claims, which scope is to be accorded the broadest interpretations so as to encompass all such modifications and equivalent structures.

What is claimed is:

1. A collapsible article carrier comprising:

an upright, substantially planar member defining a handle on an upper end thereof and a contacting surface on the edge of a lower end thereof, said edge separating opposite outwardly facing side surfaces;

first and second rigid, substantially planar support members each defining a contacting surface on an edge thereof;

hinge means for attaching said first and second support memers to said opposite side surfaces, respectively, of the lower end of said upright member and for permitting said support members to independently move between raised positions substantially parallel to said upright member and lowered positions substantially perpendicular to said upright member, said support members each connected to said upright member only by said hinge means when in said lowered position, the contacting surface defined by said first support member contacting the contacting surface defined by said second support member and the contacting surace of said upright member contacting both said first and second support members simultaneously whenever both support members are in said lowered position;

fastening means for selectively fastening said support members in said raised position to said upright member;

hook means, attached to said upright member at the upper end opposite said lower end thereof, for retaining a looped member; and retaining means, fixed to the upper end of the opposite side surfaces of said upright member, for retaining a thin sheet of material in proximity to and parallel with said upright member on said opposite outwardly facing side surfaces.

2. A carrier as in claim 1 wherein said support members each define a flat support surface, said support surfaces including means for resisting relative movement of an article in contact therewith.

3. A carrier as in claim 1 wherein said upright member comprises a rigid planar structure having an oval-shaped cut out of the center thereof.

4. A carrier as in claim 1 wherein said retaining means are L-shaped tab means fixed to and extending downward from said upper end of the opposite side surfaces of said upright member for defining a plurality of retaining slots adapted to retain an edge of at least one paper grocery bag to at least one of said opposite outwardly facing side surfaces.

5. A carrier as in claim 1 further including a hook attached to said upright member at said upper end thereof, said hook extending away from said lower end of said upright member.

6. A collapsible grocery bag carrier an upright, substantially planar member defining a handle at an upper end thereof and having opposite outwardly facing side surfaces and a lower end;

a rigid, substantially planar support member;

hinge means for attaching said support member to the lower end of said upright member and for permitting said support member to move between a raised position whereat said upright member and said support member are parallel to one another and a lowered position whereat said support member and said upright member are perpendicular to one another;

upwardly-extending hook meas, attached to said upright member at said upper end thereof, for retaining a looped member;

L-shaped tab means, fixed to and extending downward from an upper end of the opposite side surfaces of said upright member opposite said lower end thereof, for defining a plurality of retaining slots parallel to said upright member on said opposite outwardly facing side surfaces.

* * * * *